United States Patent [19]

Sirbola

[11] Patent Number: 4,855,020

[45] **Date of Patent: * Aug. 8, 1989**

[54] APPARATUS AND METHOD FOR THE ELECTROLYTIC PLATING OF LAYERS ONTO COMPUTER MEMORY HARD DISCS

[75] Inventor: Michael A. Sirbola, Houston, Tex.

[73] Assignee: Microsurface Technology Corp., Houston, Tex.

[ * ] Notice: The portion of the term of this patent subsequent to Jan. 19, 2005 has been disclaimed.

[21] Appl. No.: 144,019

[22] Filed: Jan. 12, 1988

Related U.S. Application Data

[63] Continuation-in-part of Ser. No. 806,081, Dec. 6, 1985, Pat. No. 4,720,329, and a continuation-in-part of Ser. No. 651,493, Sep. 17, 1984, abandoned.

[51] Int. Cl.[4] ..... C25D 7/00; C25D 17/00

[52] U.S. Cl. ..... 204/23; 204/212; 204/218; 204/228; 204/DIG. 7; 360/135

[58] Field of Search ..... 204/23, 212, 215, 216, 204/217, 218, 5, 228, DIG. 7; 360/135

[56] References Cited

U.S. PATENT DOCUMENTS

| | | | |
|---|---|---|---|
| 526,482 | 9/1894 | Bridgman | 204/212 |
| 1,029,965 | 6/1912 | Aylsworth | 204/5 X |
| 1,073,868 | 9/1913 | Perreur et al. | 204/212 |
| 1,347,088 | 7/1920 | Greenawalt | 204/212 |
| 2,438,885 | 4/1948 | Bell | 204/212 |
| 2,675,348 | 4/1954 | Greenspan | 204/5 X |
| 3,236,757 | 2/1966 | Litt | 204/212 X |
| 3,470,082 | 9/1969 | Raymond et al. | 204/228 |
| 4,144,160 | 3/1979 | Faulkner | 204/212 |
| 4,304,641 | 12/1981 | Grandia et al. | 204/23 |
| 4,359,375 | 11/1982 | Smith | 204/212 |
| 4,415,423 | 11/1983 | Brooks | 204/212 |
| 4,720,329 | 1/1988 | Sirbola | 204/23 |

*Primary Examiner*—G. L. Kaplan

*Attorney, Agent, or Firm*—Harrison & Egbert

[57] ABSTRACT

An apparatus for the electrolytic plating of computer memory discs comprising a plating container for the receipt of a liquid plating bath, a spindle fitted to the plating container, a prime mover connected to the spindle for causing relative rotational movement, a fixed and non-translatable stationary anode attached to the plating container, an electrical transmission system connected to the spindle and to the anode, and suitable current distribution controllers positioned within the plating container. The spindle has a receiving area for fixing to the inner diameter of a computer memory disc. The stationary anode is positioned on opposite sides of the receiving area of the spindle. The electrical transmission system includes a contact surface for establishing electrical contact with the edge of a computer memory disc. The current distribution controllers are adjacent the contact surface of the electrical conductors.

42 Claims, 11 Drawing Sheets

APPARATUS AND METHOD FOR THE ELECTROLYTIC PLATING OF LAYERS ONTO COMPUTER MEMORY HARD DISCS

RELATED APPLICATIONS

The present application is a continuation-in-part of United States patent application Ser. No. 806,081, filed Dec. 6, 1985, and entitled "Apparatus and Method for the Electrolytic Plating of Layers Onto Computer Memory Hard Discs", now Patent No. 4,720,329. U.S. application serial No. 806,081 was continuation-in-part of U.S. patent application Ser. No. 651,493, filed Sept. 17, 1984, and entitled "A Method for the Electrolytic Plating of Various Metallic Layers Onto a Computer Memory Hard Disc Such That An Extremely Smooth Surface With Precisely Controlled Grain Structure Results", now abandoned.

FIELD OF THE INVENTION

This invention is directed to improvements in plating elements and associated apparatus and methods; more particularly, it is directed to methods and apparatus for the electroplating of thin metal layers onto the aluminum substrate of a computer disc.

BACKGROUND ART

In present-day data processing systems, it is the usual practice to employ magnetic memory discs for storing binary bits representing digital data. The memory discs usually comprise a magnetic disc which is scanned by a magnetic transducer head. The magnetic head is capable of inducing flux reversals in the magnetic domains of the disc and, in turn, of reading a pattern of magnetic orientations on the disc, and translating changes in the magnetic orientation into a series of digitally encoded binary bits.

Several types of magnetic head/magnetic memory disc interfaces are used in present-day data processing systems. For example, magnetic tape memories and floppy magnetic disc memories include magnetic heads which are in intimate contact with the magnetic memory. Another type of magnetic memory is known as the Winchester type which uses rigid magnetic discs. The Winchester magnetic disc memory provides maximum reliability and minimum error generation by eliminating physical contact between the magnetic head and the magnetic disc. This is achieved by means of a flying magnetic head which does not actually contact the surface of the magnetic disc.

It is evident that for maximum efficiency it is essential that the actual displacement of the head from the surface of the magnetic disc be kept at a minimum. Present-day systems are available in which the displacement is of the order of 10–14 microns. Accordingly, for satisfactory operation of the Winchester system it is essential that the surface of the magnetic disc be extremely flat and uniform.

The magnetic disc for the Winchester system is currently prepared from a slurry of gamma ferric oxide mixed in a matrix of an organic material capable of forming a thin uniform magnetic film. A rigid disc was used and the magnetic film deposited on the disc was burnished to provide the uniform surface characteristics required in that type of drive.

U.S. Pat. No. 3,634,047, issued to Faulkner, disclosed a method and apparatus for electroplating the magnetic film on the disc substrate so as to provide a magnetic memory disc suitable for use in the Winchester system. However, prior to the electroplating of the main magnetic film, practice is to provide a fine grain paramagnetic film. This is usually achieved by electroless deposition of a film of paramagnetic nickel/phosphorus material. However, prior to the electroplating of the main film, it is necessary for the paramagnetic nickel/phosphorus film in accordance with the prior art techniques, to be burnished and polished so as to remove some of the nodules that result from the electroless deposition process.

U.S. Pat. No. 3,634,209, issued to Wolf describes a process for producing magnetic memory devices in which the nickel/phosphorus fine grain paramagnetic film is deposited on the substrate by electroplating means, and in which the main magnetic film is then electroplated over the paramagnetic film. However, again, in order to achieve the uniform density required for the Winchester-type of system, the paramagnetic nickel/phosphorus film must be polished and burnished prior to electroplating the main magnetic film.

The requirement for burnishing and polishing in the prior art methods is primarily due to the difficulty of maintaining constant current densities over the entire plating surfaces of the disc during electroplating. In particular, since the thickness of an electrodeposit at any point on a plateable surface is proportional to the time integral of the current density developed during electroplating, the lack of close control over current density in conventional electroplating apparatus has made it very difficult to plate magnetic surfaces capable of high density recording.

Accordingly, the prior art approach to provide a magnetic memory disc capable of high density recording and suitable for use in a Winchester system usually involves the following steps:

(1) An aluminum substrate is prepared by stamping a plate into the proper pre-defined dimensions. Standards have been defined by the American Society for Testing Materials for discs of fourteen inch, eight inch, five and one-quarter inch and 3.1 inch outer diameters.

(2) The substrates are then machined and stress relieved to obtain the finest tolerances possible.

(3) The substrates are then diamond turned and/or polished to an extremely fine finish.

(4) The polished substrates are then subjected to a series of plating operations to place a thin film of fine grain paramagnetic nickel/phosphorus material over the surface of the substrate. This film may be of the order of 0.0002 inches thick. The film may be deposited on the polished substrates either by electroless deposition techniques, or by electroplating as described in the Wolf patent.

(5) The coated substrates are then polished again in an effort to remove some of the nodules that result from the deposition process.

(6) After the polishing operation, the discs are reracked and subjected to an electroplating operation, for example, such as described in the Faulkner patent, so that the main magnetic film may be deposited over the paramagnetic film with the required overall degree of uniformity.

(7) A protective barrier coating may then be formed over the surfaces of the plated disc.

The prior art methods, as described above, are relatively expensive, especially in the requirements of the polishing and burnishing operations. These operations are usually performed manually, and are the leading causes for product failure.

Additional problems occur when the paramagnetic nickel/phosphorus film is deposited by electroless methods due to slight variations in the characteristics of the film over the surface of the disc. These variations result in major changes in the signal response during read/write operations.

An important objective of the present invention is to provide a method and process by which the paramagnetic nickel/phosphorus film may be deposited on the substrate by electroplating techniques, so as to obviate the problems encountered when electroless deposition is used, and by which the paramagnetic film is provided with a high degree of uniformity so as to eliminate any need for the time consuming and expensive manual polishing and burnishing operations.

There is another object of the present invention to provide a method and apparatus for the electrolytic plating of computer hard discs that is suitable for mass production.

It is a further object to the present invention to provide a method and apparatus of electrolytic plating that allows the current densities at the cathodes and anodes to be independently controlled.

It is still another object of the present invention to provide a method and apparatus of electrolytic plating to eliminate the build-up of material at the edges of the computer memory disc.

It is another object of the present invention to provide a method of apparatus of electrolytic plating that enables the use of soluble anodes.

It is still a further object of the present invention to provide a method and apparatus of electrolytic plating that simplifies the process of loading the computer discs onto the shaft.

These and other objects and advantages of the present invention will become apparent from a reading of the attached specification and appended claims.

DISCLOSURE OF THE INVENTION

The present invention is an apparatus for the electrolytic plating of computer memory discs that comprises: a plating bath container; a spindle rotatably mounted to the plating bath container; a prime mover connected to the spindle for applying rotational energy to the spindle; a stationary anode fashened to the plating bath container; and an electrical transmission system connected to the disc on the spindle and to the anode for passing electrical current between the disc and the anode. The disc is mounted radially about a receiving area on the spindle. The anode is positioned relative to the plating bath container so as to be on opposite sides of the disc. The disc has a central aperture that fits about the diameter of the receiving area of the spindle. The disc acts as a cathode in the presence of current from the electrical transmission system. The disc is an aluminum substrate that has beveled edges about the inner diameter and about the outer diameter of the disc.

The present invention further includes suitable current distribution control means positioned so as to be adjacent the area of electrical contact between the spindle and the edge of the computer disc. This current distribution control mechanism is for reducing the current flow between the anodes and the edge of the computer memory discs.

The spindle of the present invention includes a conductive rod extending through the interior of the spindle. A collar surrounds the conductive rod and has a non-conductive outer coating. The receiving area of the spindle has a beveled surface for receiving the inner edge of the computer disc. This receiving area is electrically conductive with the conductive rod. The electrical transmission system is electrically connected to the conductive rod for passing a current to the beveled surface. The collar is comprised of conductive material adjacent to the conductive rod. A non-conductive coating extends over the exterior of this collar.

The plating bath is contained by the plating bath container. The plating bath has a depth sufficient for the complete submerging of the disc. Ideally, the plating bath has a depth of greater than five inches (5").

The current distribution control system of the present invention comprises a septum positioned within the plating container between the receiving area of the spindle and the anode. This septum serves to limit the flow of current reaching the edges of the computer disc. The septum is a non-conductive sheet having a generally circular opening. This circular opening has a radius generally matching the radius of the computer memory disc. A plurality of projections extend inwardly of this circular opening. The septum also has an inverted V-shaped inwardly extending area at the bottom of the circular opening. This inverted V-shaped area has a vertex aligned with the center of the cross section of the spindle. The projections on the septum take on a scalloped configuration. The circular shape of the septum opening is approximately 270 degrees of a circle. Ideally, a first septum is positioned between the stationary anode and the receiving area of the spindle and a second septum is positioned on the other side of the receiving area of the spindle. The first and second septums are in plane parallel with each other and are perpendicular to the bottom of the plating container.

The stationary anode is fixed and non-translatable relative to the plating container. The stationary anode is positioned on opposite sides of the receiving area of the spindle. The anode of the present invention comprises an anode vessel mounted to the plating container perpendicular to the bottom of the plating container. This anode vessel has an interior area for the receipt of anodizing material. The anode vessel has a non-anodizing screen fastened to the anode vessel so as to allow the liquid plating bath to communicate with the interior area of the anode vessel. This non-anodizing screen has a first curvilinear edge generally corresponding in size with the radius of the receiving area of the spindle. The non-anodizing screen has another curvilinear edge connected to the anode vessel and has a radius greater than the radius of the first curvilinear edge. The non-anodizing screen comprises a flat section of titanium mesh. The anode vessel includes a plurality of anodic pellets contained within the interior area of the anode vessel.

The electrical transmission system comprises a plurality of current regulators connected to each of the anodes. The current regulator is for controlling the magnitude of current flow to the anode. The electrical transmission system is suitable for passing between 25 and 200 milliamps per square inch of surface area of the disc.

The prime mover causes the spindle to rotate at between 8 to 18 revolutions per minute. The prime mover comprises a motor that is external at the plating bath container. This motor has a shaft extending therefrom and a first gear fastened to the shaft. A second gear is connected to the spindle and engages the first gear. The actuation of the motor causes a corresponding rotational motion to be imparted upon the spindle.

The present invention is also a method of electrolytically plating computer memory discs that comprises the steps of: (1) fastening the computer memory discs about a receiving section of a spindle such that the disc extends radially from the spindle; (2) submerging the computer memory disc entirely into an electrolytic plating bath; (3) rotating the spindle and the computer memory disc in the plating bath; and (4) transmitting an electrical current through the spindle to the disc. The electrical current that is transmitted to the disc is passed from the disc to an anode adjacent the disc in the bath. The disc is continually rotated while the current is being transmitted and the electrolytic plating continues.

The method of the present invention further comprises the steps of removing the electrical current from the disc, removing the discs and the spindle from the electrolytic plating bath, and removing the disc from the spindle.

DETAILED DESCRIPTION OF THE INVENTION

Figure 10:
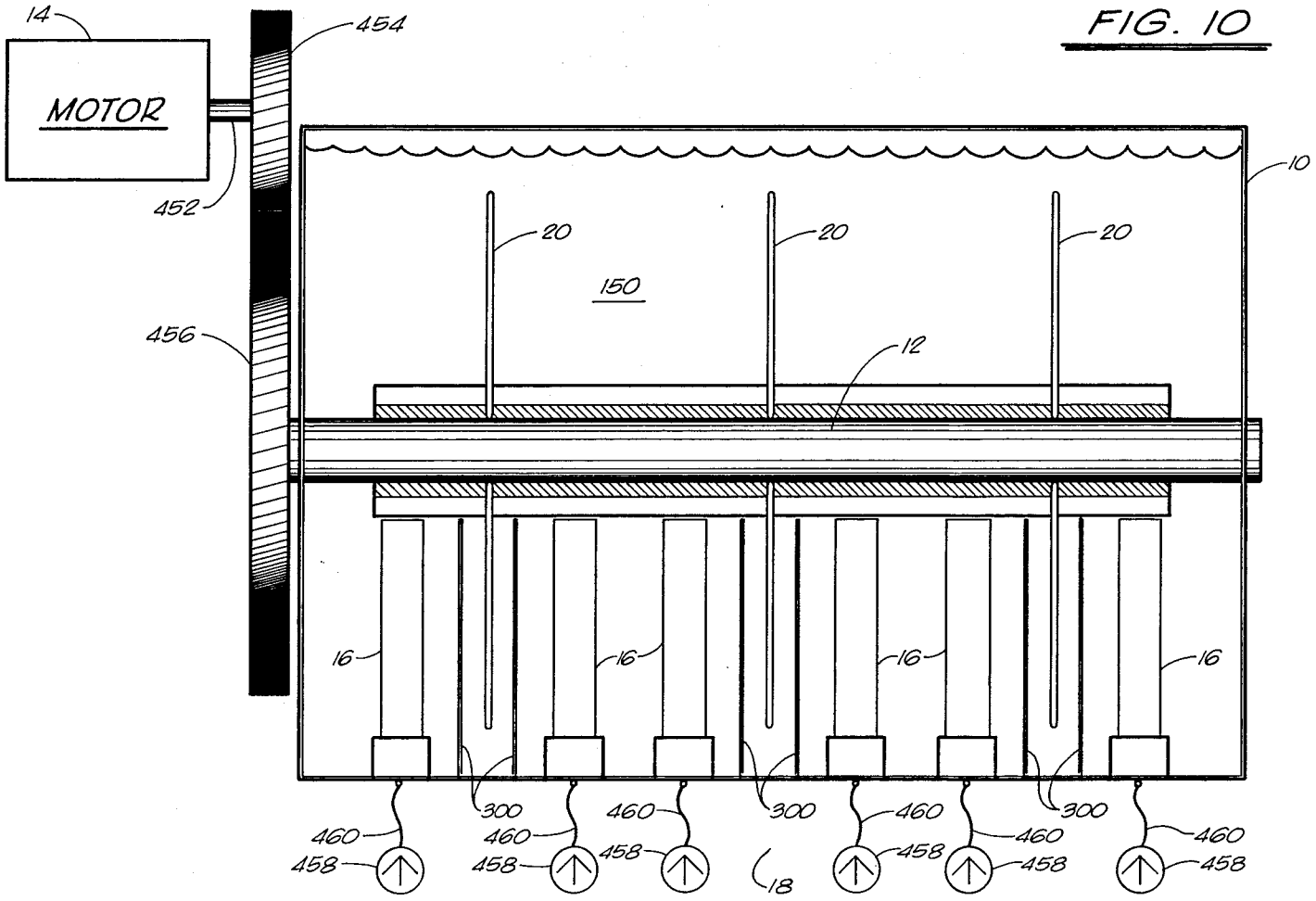
FIG. 10 shows a cross-sectional view in side elevation of the arrangement of the anode/disc configuration within the plating container of the present invention.

The present invention is an apparatus for the electrolytic plating of layers onto a computer memory disc. As shown in FIG. 10, the present invention comprises a plating container 10, a spindle 12, a prime mover 14, anodes 16, and electrical transmission system 18. DIscs 20 are mounted on spindle 12 and act as cathodes in the electrolytic plating process of the present invention. Each of the components of the present invention, as shown in FIG. 10, are shown in greater detail in the other figures.

Figure 1:
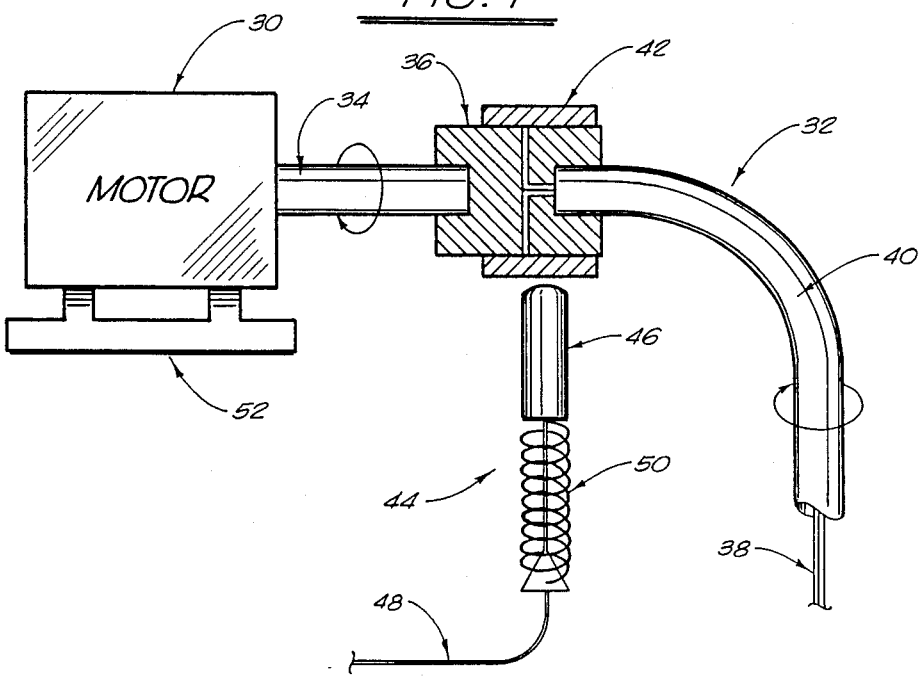
FIG. 1 shows a cross-sectional view in side elevation of the motor which rotates the spindle and the connector to the power supply.

In FIG. 1, there is shown the prime mover and a portion of the electrical transmission system of the present invention. As shown in FIG. 1, motor 30 is a motor of either set or variable rotational speed. By being mounted to the top of or adjacent to the plating fixture, motor 30 transfers its rotational energy along the shaft 32 to the spindle and the attached disc. Shaft 32 is connected to motor shaft 34 via a rigid coupling 36. Shaft 32 is a flexible drive which, when rotated at one end, effects rotation at the other end. Shaft 32 is composed of two parts, an inner conductive wire of braided copper wire 38, and an outer non-conductive insulating covering 40. Rigid coupling 36 serves to transfer rotational energy from the motor shaft 34 to the flexible drive 32 and to maintain electrical contact with the discs as they rotate on the spindle. The inner conductive wire 38 is connected to the outer surface 42 of the coupling 36. Coupling 36 is a smooth cylinder of copper. Electrical energy is transferred to the conductive wire 38 by the use of a commutator brush 44. Commutator brush 44 can be found in most electrical motors. Brush 44 is comprised of a piece of carbon 46 which is conductively attached to a source of electrical energy by a wire 48. Wire 48 is kept in mechanical contact with the copper cylinder 42 of coupling 36 by a spring 50. Motor 30 is rigidly fastened to a base 52.

Relative to the prime mover configuration of the present invention, it is believed that a wide variety of different types of prime movers can be attached to the spindle 12 of the present invention so as to effect the proper transmission of electrical energy and rotational energy. The arrangement illustrated in FIG. 1 is of a type that is suitable to the operation of the present invention. However, the arrangement shown in FIG. 1 is not critical to the successful operation of the present invention. Various forms of motors and electrical transmission can be utilized to accomplish similar purposes.

Figure 2:
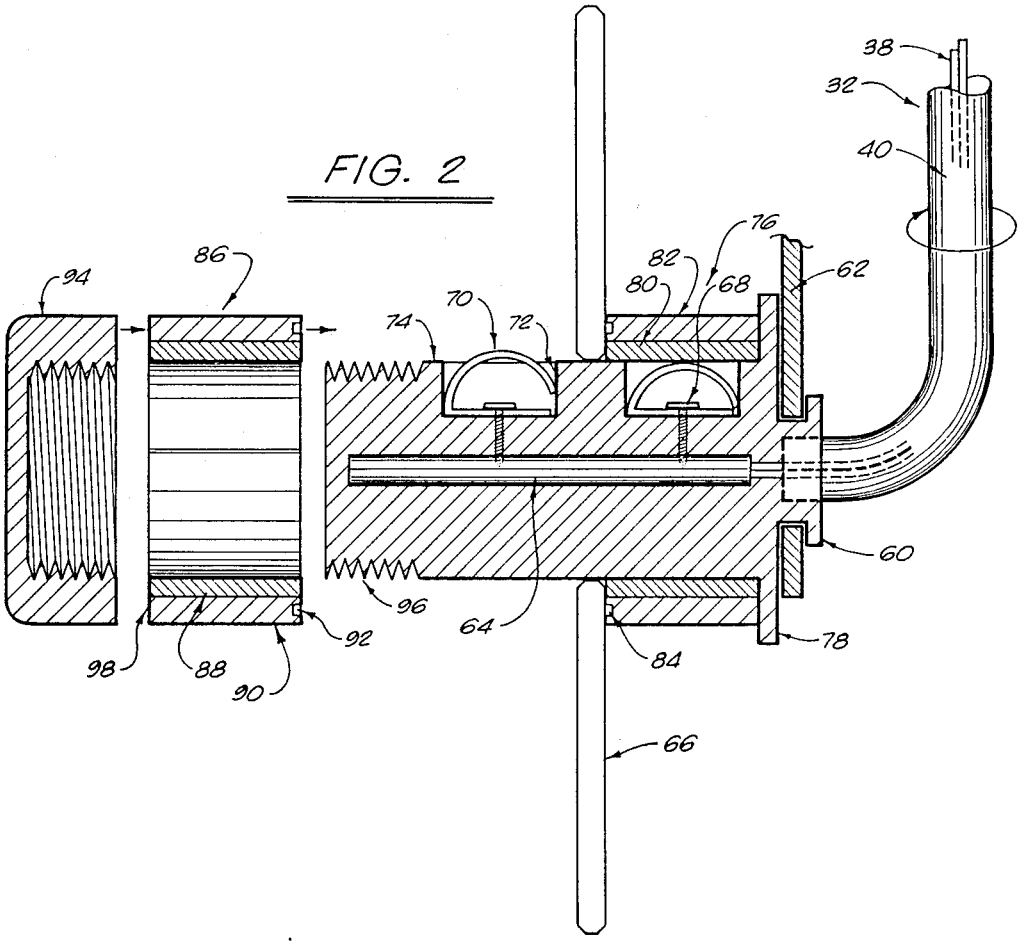
FIG. 2 is a cross-sectional view in side elevation of one embodiment of the fixturing for the computer memory disc and the means for supplying them with current as cathodes.

FIG. 2 shows one embodiment of a mechanism by which rotational and electrical transference is maintained with the motor and power supply of FIG. 1. The flexible shaft 32 is rigidly attached to a non-conductive spindle 60. Non-conductive spindle 60 has an outer diameter that is just barely large enough for the internal diameter of the disc to fit over and onto. Spindle 60 is fastened to and rotates in unison with flexible shaft 32. The rotating spindle 60 is maintained mechanically stable by the use of the plating bath fixture frame 62. The conductive cable 38 is attached to a copper rod 64 which runs through the center of spindle 60. Conductive screws 68 are located one-half of the way between each disc 66 on the spindle 60. Conductive screws 68 are contact members which maintain electrical contact between the copper rod 64 and the folded copper contact strips. Contact strips 70 are inset into grooves 72 cut into the spindle 60 at points between each disc. The folded portion of strip 70 juts above the level of the outer diameter 74 of spindle 60. Cylindrical spacer 76 is positioned about the outer diameter 72 of spindle 60 between lip 78 and the disc 66. Cylindrical spacer 76 is slipped over the spindle 60 such that the flexible band of contact strip 70 is compressed so that a good electrical contact becomes established. The inner portion 80 of spacer 76 is comprised of a conductive material, such as copper. The outer portion 82 is comprised of an insulator, such as polypropylene. The inner, conductive portion 80 of spacer 76 maintains contact between the contact strip 70 and the disc 66. Disc 66 fits between each spacer as the spacer is placed over the spindle 78. Firm contact is maintained between the inner portion 80 of the spacer 76 and the disc 66 by compressing them against each other. An O-ring 84 is placed into a notch formed about the outer portion 82 of spacer 76. O-ring 84 is compressed against the surface of disc 66 such that O-ring 84 maintains a fluid-tight contact between the disc and the outer portion of spacer 76.

A second spacer 86 is also placed over the outer diameter 74 of spindle 60. Spacer 86 is placed on the opposite side of disc 66. Spacer 86 is a cylindrical member having an inner conductive layer 88 and an outer insulative layer 90. As with the first spacer 76, an O-ring 92 is fitted about the end of spacer 86 adjacent disc 66. O-ring 92 maintains fluidtight contact between the disc 66 and the spacer 86. Electrical energy is passed from the contact strip 70, through conductive layer 88, to the inner diameter of disc 66.

An end cap 94 is threaded onto the end 96 of spindle 60. End cap 94 abuts the end 98 of spacer 86. The firm contact between the spacers 76 and 86 against disc 66 is maintained by tightening the end cap 94 about the threaded area 96 of spindle 60. Lip 78 at the opposite end of the spindle 60 serves as a backstop to the pressure caused by the threading of the end cap 94.

Figure 4:
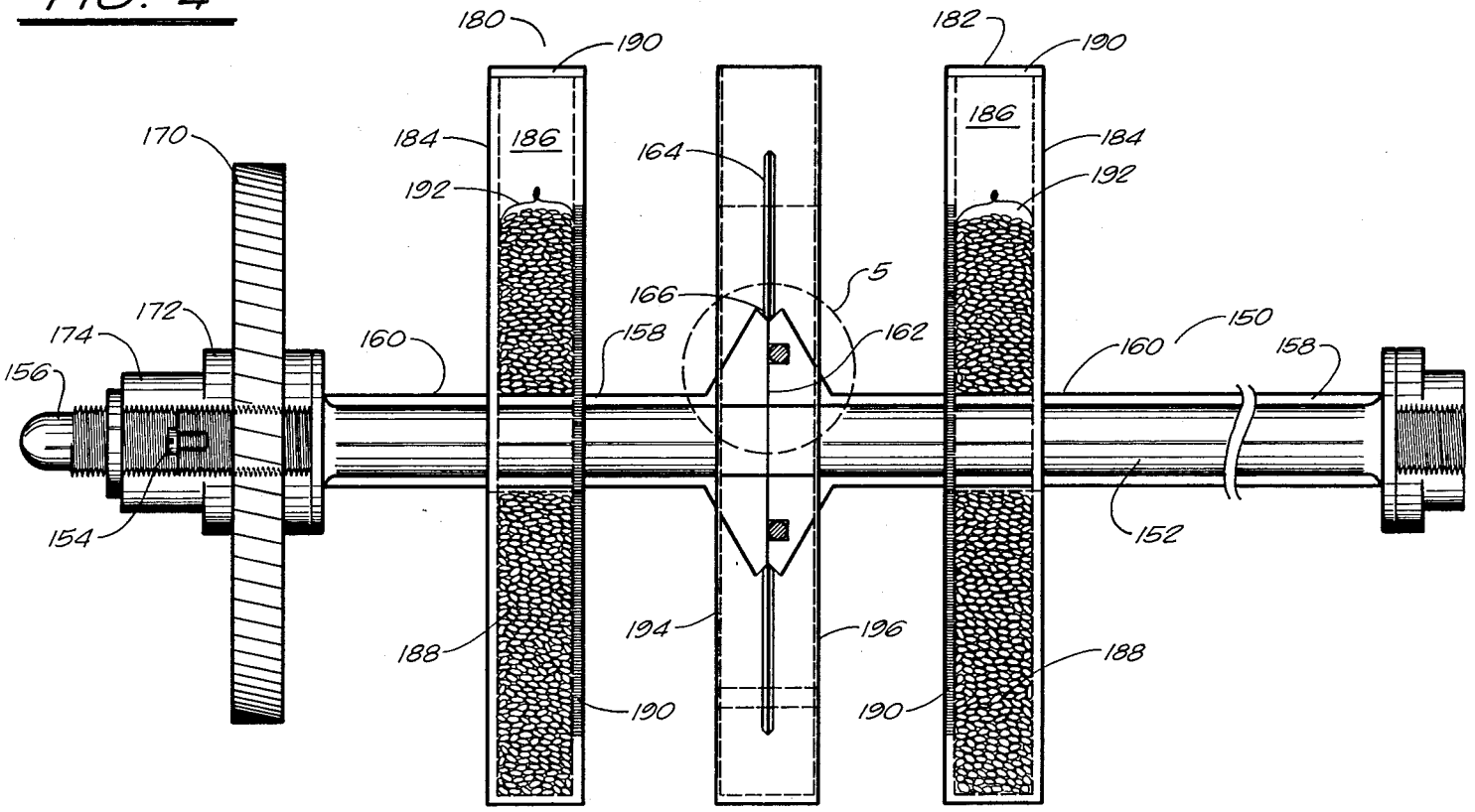
FIG. 4 is a view in side elevation and in partial cross section of the preferred embodiment of the spindle as received by the fixturing of the present invention.
Figures 11, 12, 13:
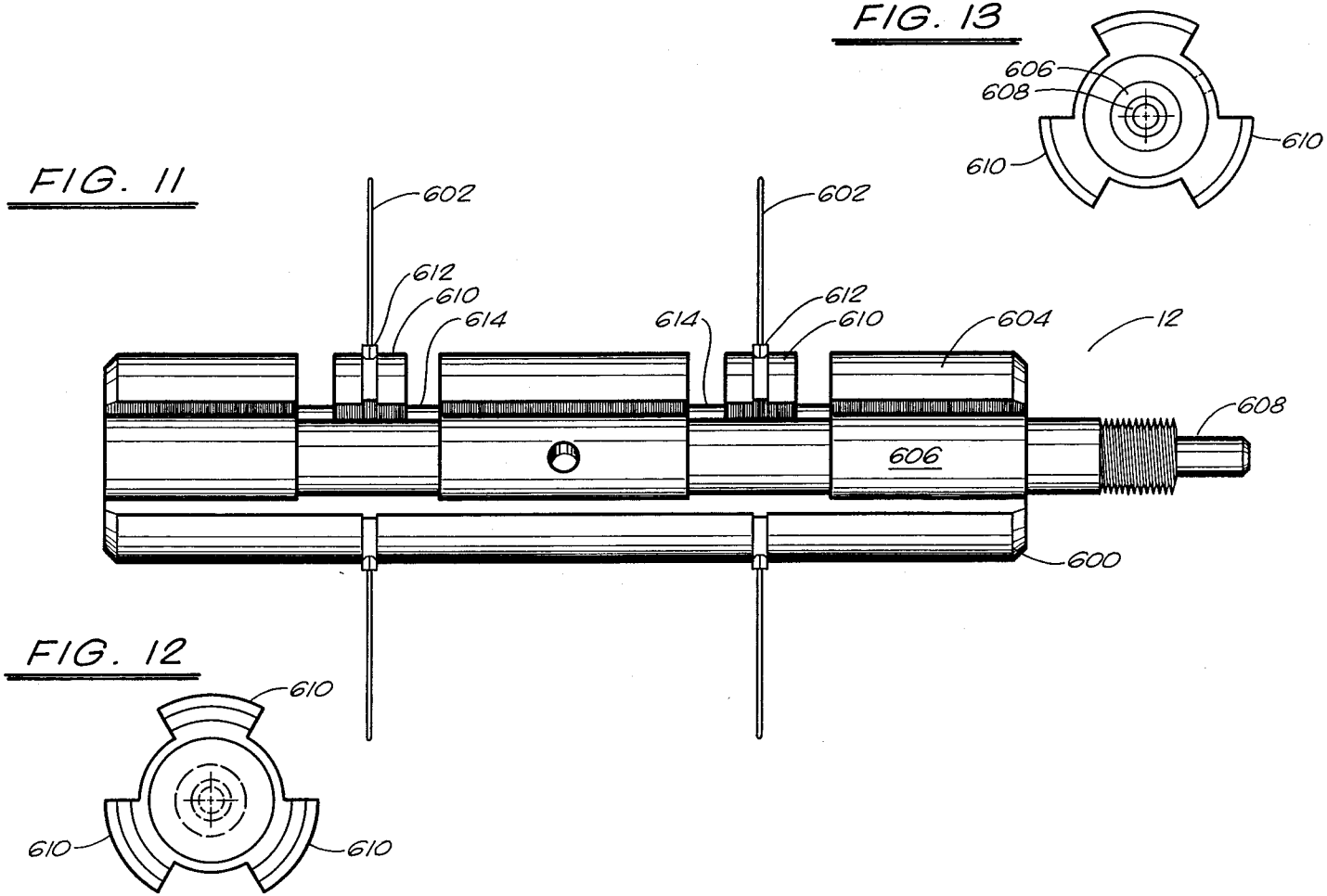
FIG. 11 is a view in side elevation of an alternative spindle as utilized in the present invention.
FIG. 12 is one end view of the spindle of FIG. 11.
FIG. 13 is the other end view of the spindle of FIG. 11.

Although FIG. 2 illustrates one form of the configuration and arrangement of the disc 66 upon the spindle 78, it is believed that the configuration illustrated in FIG. 4 is preferable for proper plating and for the proper establishment of electrical contact between the disc and the spindle. Another embodiment of the spindle of the present invention is illustrated in FIGS. 11–13.

Throughout this application, it is fundamental that the computer memory discs be rotated during plating. Importantly, however, it is less important whether an internal spindle causes this rotation or whether the computer memory discs are circumferentially rotated. Although it is believed preferable to utilize the internal spindle for rotation, this should not be considered a limit on the present invention. The concept of the present invention includes circumferential rotation. Thus, the claim language "disc rotation means" should be interpreted to include both internal (spindle) techniques of disc rotation and external techniques of disc rotation.

Figure 3:
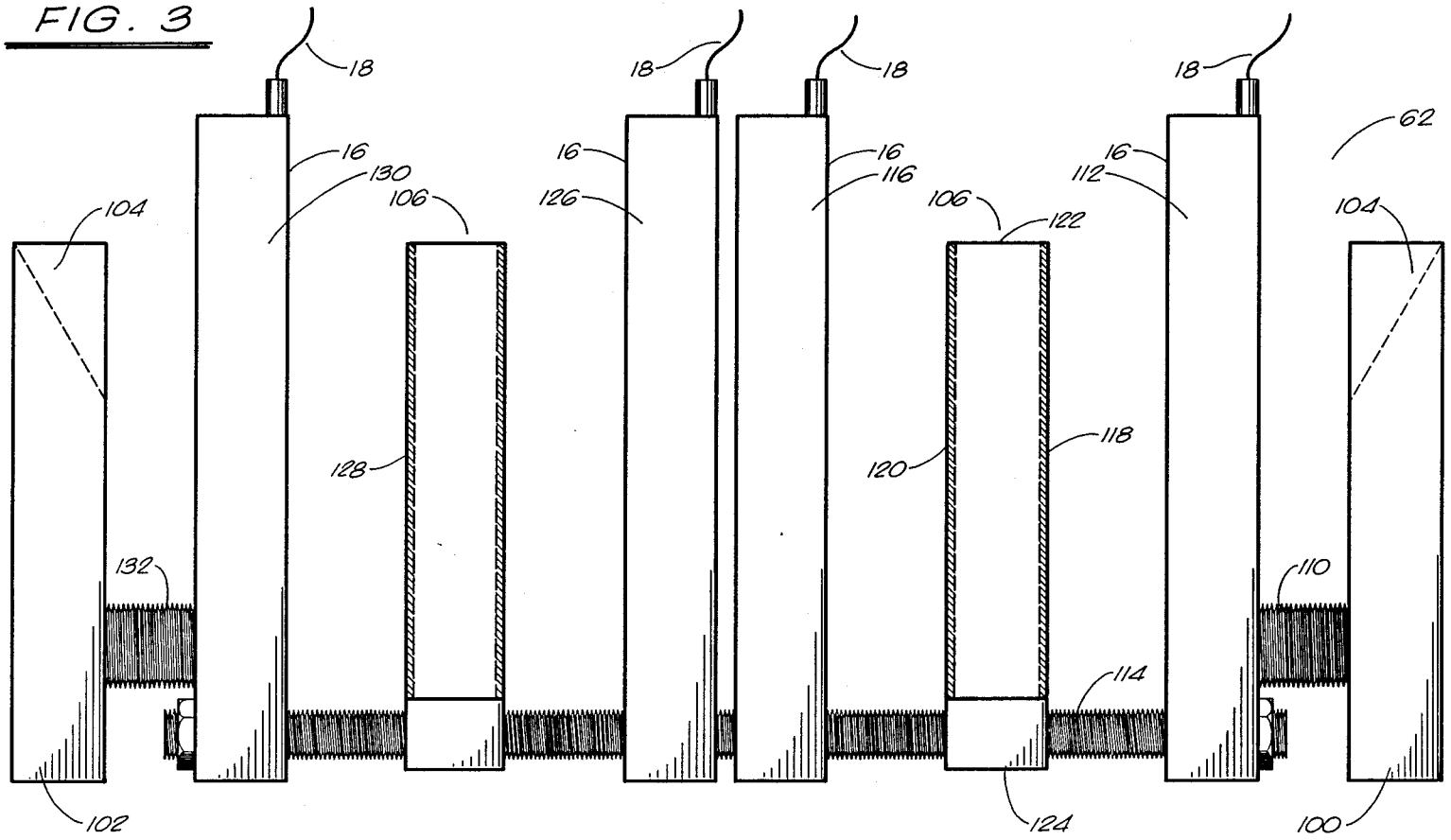
FIG. 3 is a view in side elevation of the fixturing for the receipt of the spindle in the plating container.

FIG. 3 illustrates the support structure 62 which serves to receive the spindle 12 within the plating container 10. Support structure 62 includes guide members 100 and 102. Each of the guide members 100 and 102 has an indented portion 104. The indented portion 104 will receive the ends of the spindle so as to position the spindle properly relative to the anode 16 and the current distribution control elements 106. The support structure 62 can be inserted, as a unit, into the plating container 10. The electrical transmission lines 18 are connected to each of the anodes 16. The first guide fixture 100 is fixedly connected by support 110 to the first anode 112. Depending upon the number of anodes and discs desired to be plated, the guide fixture can always be extended as needed from the end anodes. A more detailed description of the anode 112 is made with reference to FIG. 6. The current distribution control means 106 is evenly spaced across the connector bar 114 between the first anode 112 and the second anode 116. The current distribution control member comprises a first septum 118 and a second septum 120 positioned between the anodes 112 and 116. An opening 122 between the first septum 118 and the second septum 120 allows the computer memory disc to be properly inserted therebetween. A support structure 124 engages the bar 114 so as to maintain the first septum 118 and the second septum 120 in plane parallel perpendicular to the bottom of the plating container 10. Ideally, these first and second septums should be separated by at least one-eighth of an inch. A more detailed description of the septum 118 and 120 is given in connection with to FIGS. 8 and 9.

A third anode 126 is positioned adjacent the second current distribution control 128. On the other side of current distribution control 128 is a fourth anode 130. The anodes 126 and 130 and the current distribution controller 128 are positioned on connector bar 114 in the same manner as described herein previously. The second guide fixture 102 is attached by structure 132 to the fourth anode 130.

After considerable experimentation with the fixture 62 of the present invention, it was found that, for the plating of multiple discs, it was necessary to have a pair of anodes for each of the computer discs to be plated. Additionally, it was found important to have independent current controllers 18 attached to each of the anodes 16. During the plating process, there may occur changes in resistance and current patterns between the anodes and the discs. The separate controllers and separate anodes alow the plating operation to be continued under a much more controlled fashion and allow adjustments and modifications to be made during plating.

FIG. 4 illustrates the preferred embodiment of the present invention. In particular, FIG. 4 shows the relation between the anodes and the disc relative to the plating fixture. In FIG. 4, spindle 150 has a conductive stainless steel rod 152 extending through the interior. Conductive rod 152 is connected by electrical contact 154 to the electrical transmission system of the present invention. Electricity is transmitted through transmitter 156 which is in electrical contact with the conductive rod 152 within spindle 150. The collar 158 surrounds the conductive rod 152. Collar 158 has a non-conductive outer coating 160. In FIG. 4, a pair of collars 158 are shown in abutment at 162 for the purpose of fastening the computer memory disc 164 in proper position. The receiving area 166 for disc 164 is electrically conductive with the conductive rod 152. The collar 154 is comprised of stainless steel material. The area indicated at the receiving area 166 is not covered with the non-conductive outer coating. As a result, the current, as passed by the stainless steel rod 152 within collar 158, will pass to the inner edge of computer disc 164.

The configuration of FIG. 4 shows a large gear member 170 fastened about the exterior of support structure 172. The cylindrical area 174 of support structure 172 will engage the guide fixture 102 as illustrated in FIG. 3.

FIG. 4 shows a cross-sectional view of the anodes 180 and 182. Anodes 180 and 182 are located on opposite sides of the computer memory disc 164. The anodes 180 and 182 include anode vessels 184. These anode vessels 184 are mounted to the plating container 10 (or to the fixture illustrated in FIG. 3) generally perpendicular to the bottom of the plating container. The anode vessels 184 have an interior area 186 for the receipt of anode material 188. A non-anode screen 190 is fastened to the anode vessel 184 so as to allow the liquid plating bath to communicate with the interior area 186 of anode vessel 184. As can be see in FIG. 4, the non-anode screens are fastened to the side of the anodes 180 and 182 adjacent to the computer memory disc 164. In experimental use, these screens are placed approximately three quarters of an inch (¾") from the computer memory disc 164. The non-anodizing screen is comprised of a flat section of titanium mesh. As can be seen, this screen extends downwardly so as to be aligned with the outermost edge of computer memory disc 164. The interior 186 of anode vessel 184 includes a plurality of anodic pellets 188. An opening 190 at the top of the vessels 184 allows for the insertion of the anodic pellets into the anode vessel. The pellets 188 are sulphur-depolarized nickel material.

The anodes 180 and 182 may be utilized in a plating bath which calls for the use of soluble anodes. These pellet holders have the same current directing capability as pie-shaped insoluble anodes. The anode vessels 184 are designed to hold anodic pellets 188 of up to three quarters of an inch in diameter. The anode vessel 184 is a non-conductive plastic box having a large indentation so that the spindle 150 can be lowered to a proper point within this box. An anode bag 192 may be placed within the interior 186 of anode vessel 184 to minimize particulate contamination of the plating solution. After experimentation, it was found that sulphur-depolarized nickel corroded more evenly than the traditional nickel rounds. As a result, it was found that sulphur-depolarized nickel pellets were preferable.

After experimentation, it was determined that either plate anodes or reloadable anode vessels could be utilized for proper plating. The anode vessels have qualities better suited for mass production. Importantly, this should not be construed as a limitation on the present invention. As used herein, the term "stationary anode means" refers to both plate anodes and anode vessels.

Adjacent the computer memory disc 164 are septums 194 and 196. The purpose of the septums 194 and 196 is for maintaining even plating across the disc. These septums 194 and 196 are arranged in plane parallel relative to the disc 164.

Figure 5:
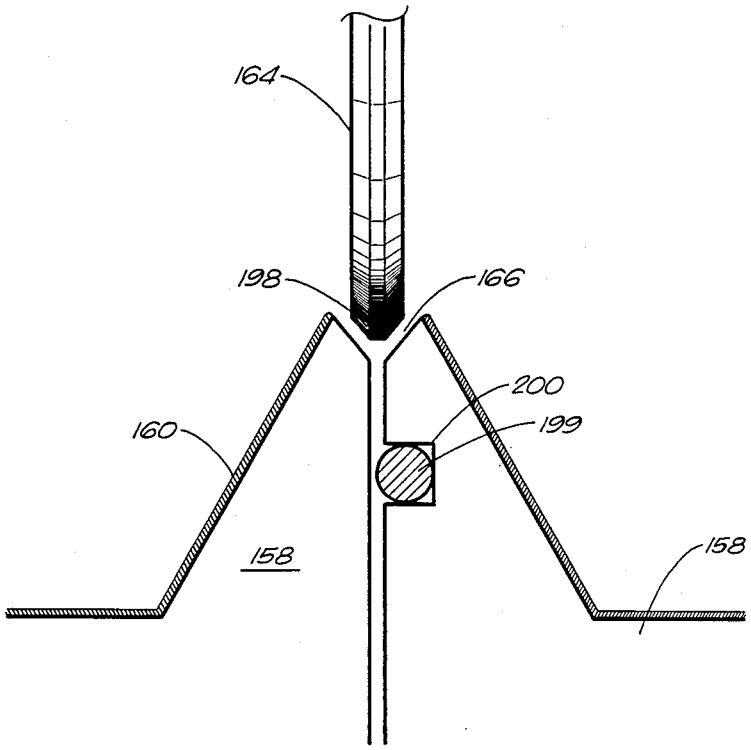
FIG. 5 is close-up view of the beveled contact surface illustrated as circled area 5 of FIG. 4.

In FIG. 5, the receiving area for the computer memory disc 164 is illustrated in close-up detail. As can be seen, collar 158 is shown with its non-conductive coating 160. The diameter of the collar 158 expands outwardly to a diameter approximately equaling the interior diameter of a computer memory disc. In FIG. 5, it can be seen that the somewhat beveled end 198 of computer memory disc 164 will fittingly engage the beveled receiving area 166 between the collars 158. An O-ring 199 is fitted into notch 200 in one of the collars. Upon abutment, the O-ring 199 will create a liquid-tight seal between the collars 158. It is important to prevent this fluid leakage since such fluid could corrode the conductive inner surface of collar 158 or otherwise create some electrolytic plating effects within this area. By allowing the somewhat beveled end 198 of computer memory disc 164 to engage the conductive surface of receiving area 166, electrical current will pass from the conductive rod 152 of spindle 150 into the collar 158 and through the computer memory disc 164. After experimentation, it was found that it is preferable to minimize the amount of edge effects between the spindle and the edges of the computer memory discs. the configuration illustrated in FIG. 5 establishes a strong electrical contact while minimizing these edge effects and minimizing the coverage of surface area of the computer memory disc.

Figure 6:
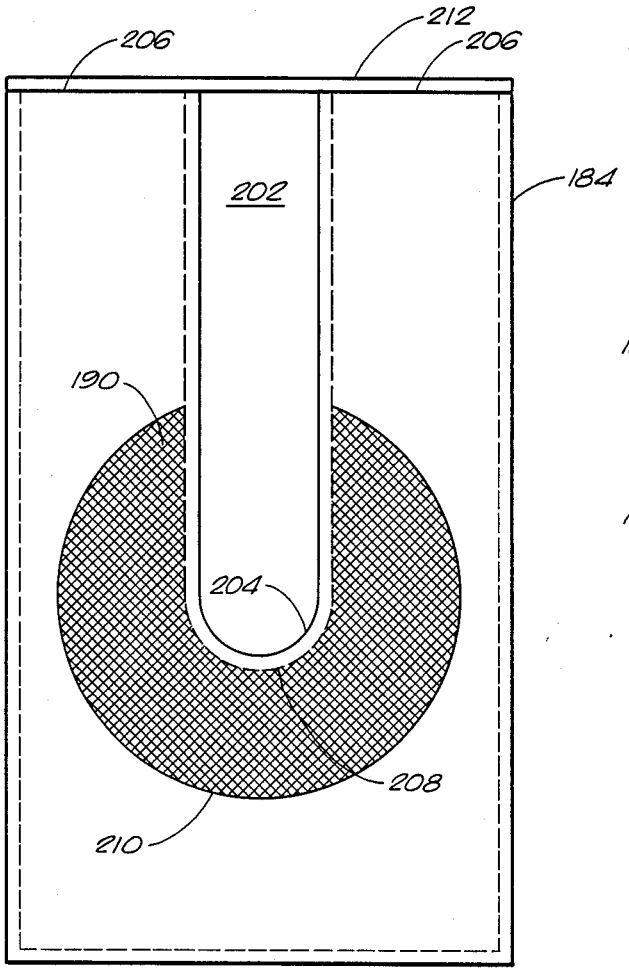
FIG. 6 is a forward view showing the anode of the present invention.

FIG. 6 is a frontal view of the anode vessel 184 illustrated in FIG. 4. As can be seen, a slot 202 extends longitudinally through the anode vessel 184. Slot 202 serves to receive the outer diameter of spindle 150. The bottom of the slot 204 allows for abutment between the spindle 150 and the anode vessel 184. Anode vessel 184 includes opening 206 at the top for the receipt of the anodic pellets therein. The non-anodizing screen 190 is fastened to the anode vessel 184 so as to allow the liquid plating bath to communicate with the interior of this anode vessel. This non-anodizing screen 190 has a first curvilinear edge 208 that has a radius generally corresponding with the radius of the inner diameter of a computer memory disc. Alternatively, this radius is equal to the receiving area 166 of spindle 150. This non-anodizing screen 190 has another curvilinear edge 210 having a radius greater than the radius of the first curvilinear edge 208. Second curvilinear edge 210 has a radius generally equal to the radius of the computer memory disc desired to be plated. The non-anodizing screen 190 is a flat section of titanium mesh. After experimentation, it was found that the present anode vessel was preferable to flat plates. As the pellets contained within the anode vessel 184 dissolve, the change of surface area of the pellets is de minimus relative to the total surface area of the pellets contained within the anode vessel. As a result, the effect on the evenness of plating caused by the dissolution of the anode plates is minimized. The convenience of mass production use of this type of anode vessel is significantly improved since the anode pellets can be loaded into the anode vessel in order to maintain a constant supply of anodizing material.

Figure 7:
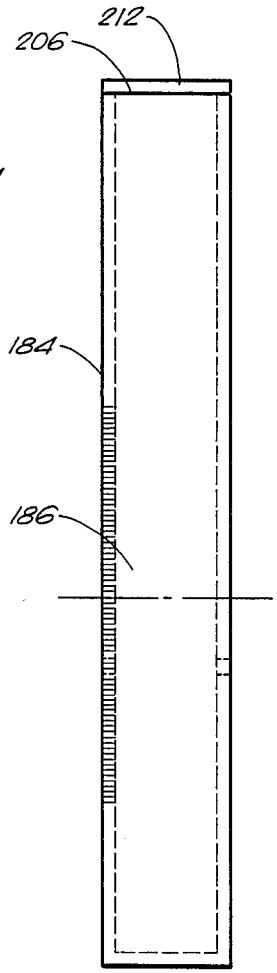
FIG. 7 is a side view of the anode of FIG. 6.

FIG. 7 is a side view of the anode vessel 184 showing the interior 186 and the removable cover 212 located at the opening 206 at the top of the anode vessel 184.

Figure 8:
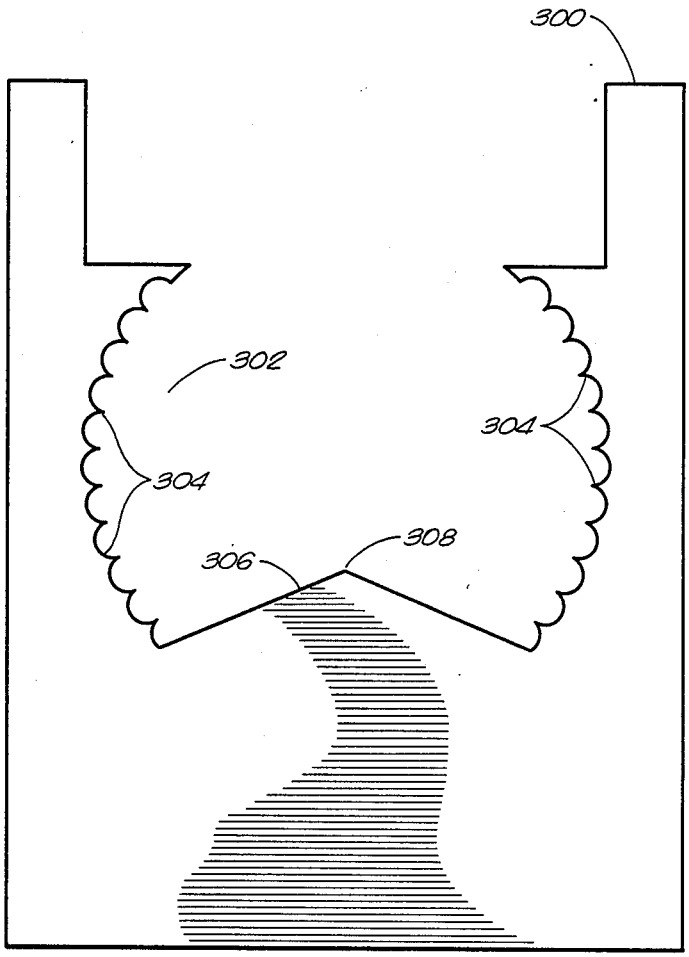
FIG. 8 is a frontal view of the septum of the present invention.

FIG. 8 illustrates the septum 300 as interposed between the computer memory disc 164 and the anodes 180. Septum 300 acts as a current distribution controller. The septum 300 is placed within the plating container 10 between the receiving area 166 of the spindle 150 and the anode 180. The septum limits the flow of current reaching the edge of the computer memory disc mounted on the spindle. Septum 300 has a generally circular opening 302. this circular opening 302, at its outermost reaches, has a radius generally matching the radius of the outer diameter of a computer memory disc. The circular opening 302 has a plurality of projections 304 extending inwardly. Additionally, the septum 300 has an inverted V-shaped area 306 extending inwardly at the bottom of the circular opening 302. This inverted V-shaped area 306 has a vertex 308 which is aligned with the center of the cross section of the spindle 150. The projections 304 have a scalloped configuration. The opening 302 forms approximately 270 degrees of a complete circle. The septum 300 is comprised of a non-conductive material.

In order to maintain even plating across the disc, it is necessary to place the septum 300 directly adjacent the disc with the protrusions on either side to impede the flow of current to the outside edge. Although a variety of patterns seem to provide adequate blockage, the preferred structure is illustrated in FIG. 8. The preferred structure is a sheet close to and parallel to the disc which covers the edge of the disc with a series of scalloped projections. This allows current to directly approach the edge of the disc only at the bottom of each scallop and therefore limit the current reaching the edge.

Importantly, the present invention should not be limited by the particular pattern utilized in this method of controlling the current reaching the computer memory disc. As stated previously a variety of patterns can be used to accomplish the same purpose. Alternatively, "current robbers" could be utilized for the purpose of drawing current to a "false" edge of the disc. These "current robbers" can be attachements about the spindle interposed between the edge of the disc and the spindle or they can be adjacent to the outer edge of the disc. The important concept contained herein is that it is important to avoid the "edge" effects of plating on a computer memory disc. This can be done either by blocking the current flow to the disc, or by redirecting the flow of current to a "false" edge of the disc. As used in the claims, "current distribution control means" may include the septum described herein or may include such current robbers.

Figure 9:
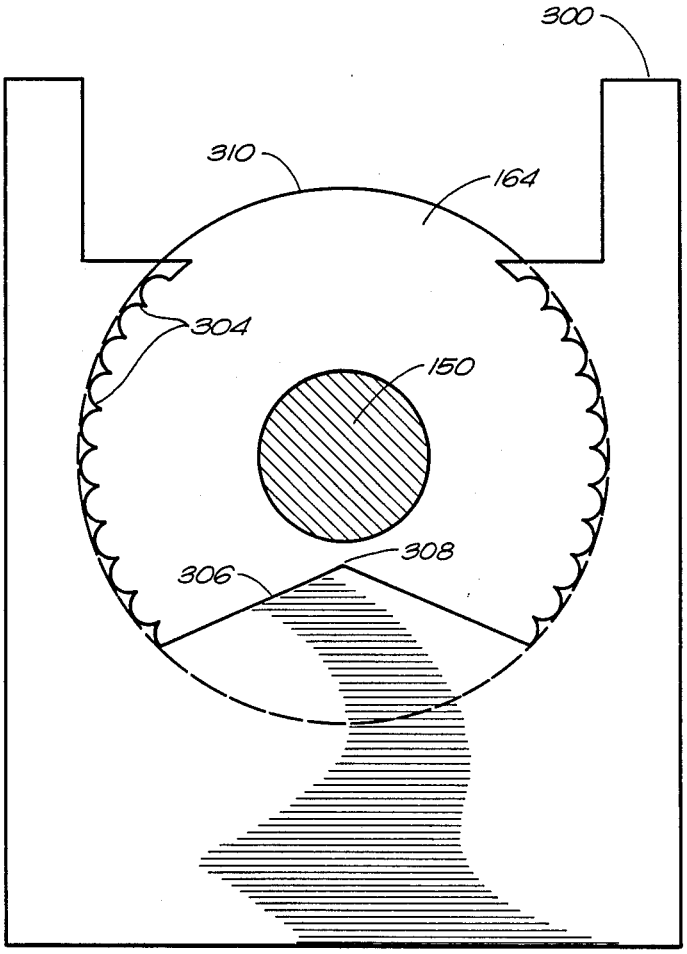
FIG. 9 is view of the septum of FIG. 8 as interposed in relation to the spindle and the computer memory disc of the present invention.

FIG. 9 shows the septum 300 as placed in relation to the computer memory disc 164 in the spindle 150. As can be seen, the vertex 308 of the inverted V-shaped area 306 aligned with the center of the cross-section of spindle 150. Additionally, it can be seen that the ends of the scalloped projections 304 are aligned with the outer edge 310. Additionally, it can be seen that the pattern covers approximately 270 degrees of the circumference of the disc 164.

FIG. 10 shows an operational embodiment of the present invention. FIG. 10 shows a generalized view of plating bath container 10. Plating bath container 10 can be any three-dimensional container that has a volume sufficient for the containment of the discs and plating solutions. A requirement of the present invention is that the discs 20 must be completely submerged within the plating bath.

In the embodiments of the present invention, the plating bath has the following components and concentrations:

100 grams/liter of Nickel Sulfate
30 grams/liter of Boric Acid
20 grams/liter of Sodium Formate
15 grams/liter of Phosphite
4 grams/liter of Sacharrin
2.5 grams/liter of Sodium Hypophosphite Each of these components and concentrations is maintained in 14 megaohm resistance deionized water. Although the composition and concentrations of materials in the plating bath can be varied in accordance with the circumstances encountered, it is important to realize that two components are important to the preferred embodiment of the present invention. These two components are: a nickel compound and a chemical that contains phosphorus. The nickel compound is essential to the proper plating of the disc. In order to deposit this nickel in a non-magnetic form, it is necessary that from ten to fifteen percent of the deposit be phosphorus.

The pH of the plating bath is preferably at 2.5. However, the range of pH can be from 2.5 to 3.5 without significantly affecting the plating characteristics of the present invention. The pH of the bath will tend to decrease as deposition of nickel occurs and can be raised by the addition of nickel carbonate. The bath pH can be lowered by the addition of dilute sulfuric acid. In the bath of the present invention, filtration at point 0.02 microinch absolute is required. The bath temperature in the preferred embodiment of the present invention can range from 100 degrees to 160 degrees Fahrenheit.

FIG. 10 shows certain variations to the configuration of the present invention. First, primer mover/motor 14 is connected by shaft 452 to a first gear 454. First gear 454 is interactive and connected with second gear 456. Gear 456 is attached to spindle 12. The interaction of the gears in combination with motor 14 creates the rotating action of spindle 12. In the preferred embodiment of the present invention, spindle 12 is rotated at between 8 and 18 revolutions per minute. The rate of rotation eliminates some swirling effects in the completed plated disc. Spindle 12 is maintained within plating bath container 10 by any number of suitable attachment means.

A variation depicted in FIG. 10 is the use of separate current regulators 458 electrically connected by lines 460 to anodes 16. The separate current regulators 458 permit individualized control over the current flowing into anodes 16. As a result, greater control can be maintained on the deposition of material onto the surface of disc 20. This will permit more individualized control over variables which may affect the electrolytic plating process of the present invention. For example, if the layer of nickel on disc 20 becomes too thick, the current flowing into anodes 16 can be reduced by a proper adjustment of current regulator 458.

After experimentation, it was found to be important to individually control each of the anodes 16. It was particularly true where the anode vessel configuration was used. In situations where the anodic pellets within the vessel shift position or rearrange themselves, it is possible that resistance could be increased or other distortions occur in current flow. By being able to individually adjust each of these anodes, corrections can be made without rearrangement of the anodic pellets or other mechanical repair to the system.

FIG. 11 shows an alternative embodiment of the spindle 12 of the present invention. The spindle 600 illustrated in FIG. 11 is designed to simplify the process of loading the computer memory disc 602 onto the shaft 604. A plurality of mechanical arms 606 extend to the interior of spindle 600. Electrical contact is established with this conductive rod 606 to connector 608. The spindle 600 is coated with a non-conductive outer coating. A plurality of mechanical arms 610 extend outwardly from the conductive rod 606. These arms 610 include a conductive contact surface 612. It is this contact surface 612 that engages the inner edge of the computer memory disc 602. By proper mechanical action, the conductive surface 612 will move outwardly so as to engage the inner diameter of computer memory disc 602. A suitable cam 614 is connected to the mechanical arm 610 for causing the conductive surface to engage the inner diameter of the computer memory disc. This motion can be instilled by turning the outer diameter of the spindle 600 in opposition to the conductive rod 606. Following the completion of plating, the cam is turned to reduce the outward pressure on the arms 610 which then release the discs so that they can be removed from the shaft.

Figure 14:
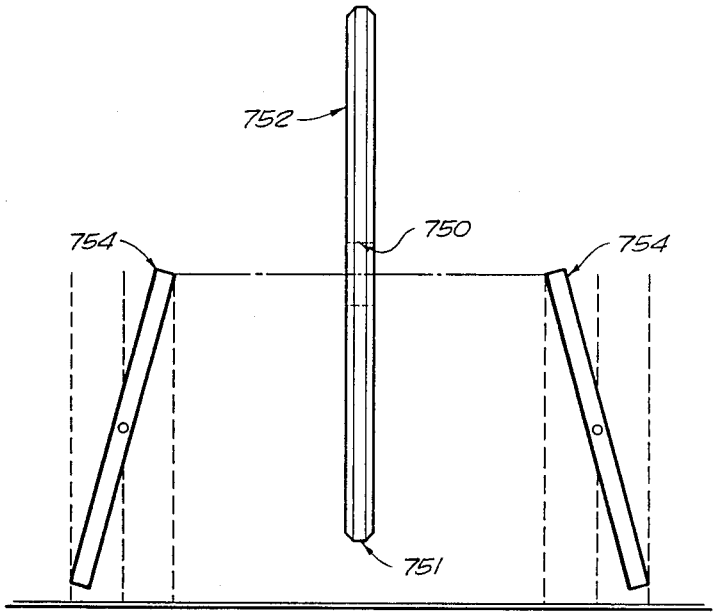
FIG. 14 shows a cross-sectional view in side elevation of an alternative arrangement of the anode/disc configuration within the plating container of the present invention.

FIG. 14 illustrates an alternative arrangement which could be used to vary the deposit thickness from internal diameter 750 to external diameter 751 of disc 752. In FIG. 7, anodes 754 are connected to mechanisms which control the inclination of the anodes 754 relative to the surfaces of disc 752. This inclination control system is operationally interactive with the anode for controllably changing the angle of approach of the anode relative to the disc. In the scheme illustrated in FIG. 7, the tilting of the anode 754 would allow a greater deposit of plating material to be deposited adjacent the inner diameter 750. In this arrangement, less plating material would be deposited about the outer diameter 751. In the alternative embodiment illustrated in FIG. 7, anode 754 could be controlled by a microprocessor to distribute plating material over curved surfaces occurring on the surface of disc 752. In many situations, the inner edge 750 and the outer edge 751 of disc 752 are somewhat beveled. To accommodate this beveled edge, it would become necessary to deposit greater amounts of plating material at these beveled portions. The controlled movement and inclination of anode 754 could be used to accomplish this purpose.

Figure 15:
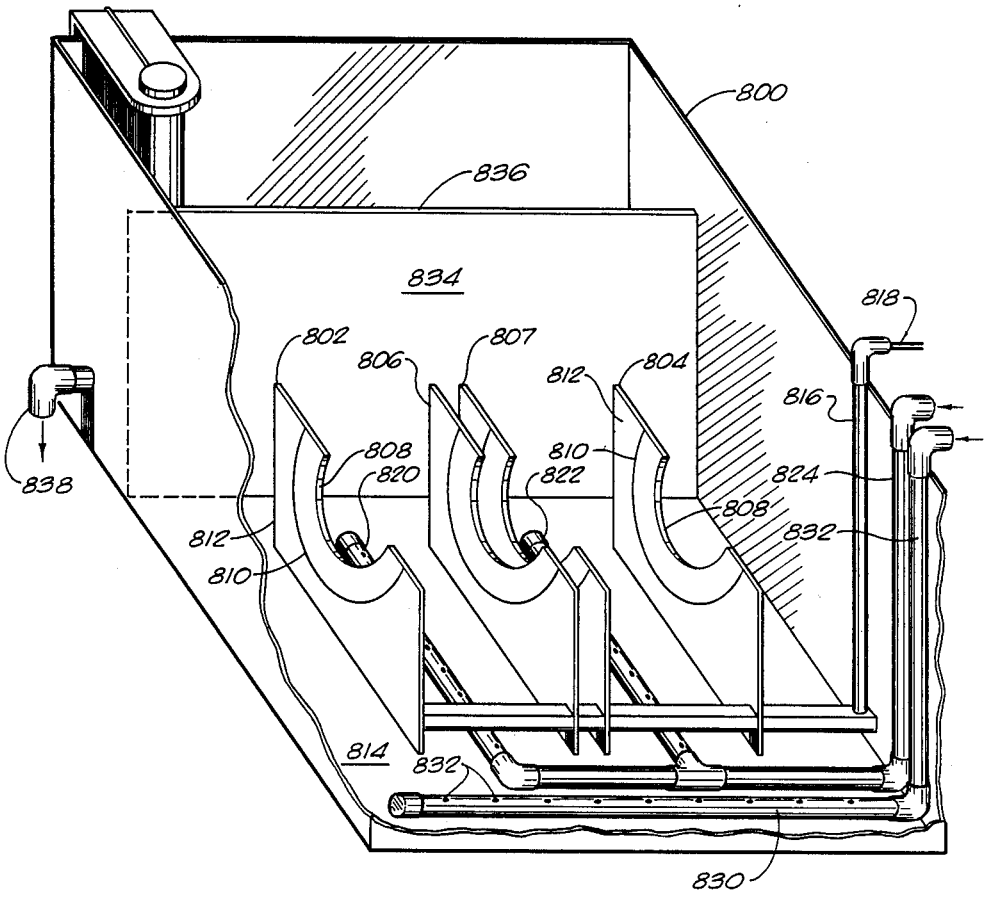
FIG. 15 is a cutaway perspective view of the internal configuration of the plating container of the present invention.

FIG. 15 shows the interior configuration of the plating bath 800. FIG. 15 illustrates the plating bath without the fixturing, spindle, or discs. Plating bath 800 has anodes 802 and 804 on opposite sides of anodes 806 and 807. It can seen in FIG. 15 that anodes 802, 804, 806, 807 have an upper curved portion 808 that corresponds in configuration to the inner diameter of the disc. The lower curved portion 810 of anodes 802 and 804 corresponds to the outer diameter of the discs. Member 812 maintains the anodes in an upright position extending perpendicular from the bottom 814 of plating bath 800.

Anodes 802, 804, 806 and 807 are supplied with current through conduit 816. Conduit 816 allows electrical lines 818 to extend from external of the plating bath 800 to the anodes.

Air agitation is important to the proper plating characteristics of certain types of discs. This air agitation is provided by perforated tubes 830 and 832. Perforated tubes 830 and 832 are connected to and communicated with central tube 824. Central tube 824 connects to a supply of gas external of the plating bath 800. The perforated tubes 820 and 822 fit between the anodes and discs. Each disc to be plated by the present invention has two such air tubes 820 and 822 extending parallel and passing air parallel to the plane of the disc surface. The combination of the air agitation as provided by tubes 820 and 822, along with the rotational method of the present invention, has a synergistic effect and allows a reproducibly homogeneous deposit.

FIG. 15 also illustrates a solution flow control system 830. Flow control system 830 acts to direct the flow of solution of the liquid plating bath in a direction parallel to the surface of the disc being plating. Flow control system 830 has perforations 832 occurring along the upper surface of the tube at the bottom 814 of plating bath 800. Flow control system 830 is also placed about the forward portions of the plating bath 800. As shown in FIG. 15, this tube 830 is placed toward the bottom forward portion of the plating bath 800. Flow control system 830 is provided with plating bath fluid through conduit 832. Conduit 832 communicates with a supply of plating solution external of plating bath 800. The plating bath solution is removed from the interior of tank 800 by passing over weir 834. As the level of fluid rises above the top edge 836 of weir 834, the fluid flows over top 836 and exits through exit tube 838. The plating bath fluid can then be recirculated, filtered, treated, or otherwise altered to make it suitable for reuse. Alternatively, the solution can be discarded.

The method of the present invention is directed to the technique of electrolytically plating computer memory discs. The first step in this method is to fasten the computer memory disc 66 about a receiving section 162 of a spindle 150. When affixed in this position, the computer memory disc 66 extends radially from the spindle 150. The second step is to submerge the spindle and the computer memory disc into an electrolytic plating bath. As shown in FIG. 10, the discs are entirely submerged into this plating bath 150. The plating bath has a composition that was described herein previously. The third step of this process is to rotate the spindle 12 and the attached discs 20 in the plating bath at a rate of eight to eighteen revolutions per minute. Fourthly, an electrical current is transmitted through the spindle to each of the discs on the spindle. The electrical current passes from the discs to the anode 16 adjacent and parallel to the discs. The discs are rotated until the plating is complete. The current is applied continually during the rotation of the spindle 12.

When the plating is completed, the process of the present invention involves the following steps. First, the electrical current is removed from the disc and the anode. Secondly, the disc is removed from the electrolytic plating bath. Finally, the disc is removed from the spindle.

When using the present invention, the disc serves as the cathode in the electrolytic plating process. In this process, the disc is rotated in front of the anode as plating occurs. This technique results in a number of benefits, which will be described hereinafter.

The rotation of the disc allows the critical mechanical surface requirements to be achieved over the entire surface of the disc. These mechanical surface requirements would be impossible to maintain without rotation. The rotation evens out the disc/anode alignment and initial disc substrate. Without rotation, these alignment or unevenness problems would be further amplified.

The technique of rotating the disc/cathode is more suitable for high-volume production since the plating rate is higher via the increased solution flow at the active plating surface. The rotation of the discs will naturally have greater surface contact with plating solution.

The use of the electrolytic method of computer memory disc plating offers a number of benefits over the previous electroless methods of deposition. In particular, the nodularity problem of electroless deposition is no longer a problem with the present invention because the electrolytic deposition occurs as if on a crystalline surface and proceeds in layer and lattice steps. The lifetime of the plating bath is potentially infinite in the electrolytic method. The plating bath cannot decompose because there are no plating by-product poisons evolved. The bath constituents are not prone to rapid changes and can be easily maintained at constant levels by the use of an amp/hour meter. Additionally, particulate contaminates in the electrolytic bath tend to be repelled from the surface of the work piece as plating commences and are not co-deposited on the surface of the disc.

In order to deposit nickel in a non-magnetic form, it is necessary that from ten to fifteen percent (10%–15%) of the deposit be phosphorus. This is accomplished by the addition of phosphorus to the plating bath. In order to have a high level of phosphorus, it is necessary that a low pH of about 2.5 be maintained. Semi-bright nickel plating usually requires the addition of certain addition agents as brighteners, levelers, and stress relievers. When a few of these operate at low pH, many of these decompose if subjected to pulse plating. On the other hand, these addition agents are stable under constant current DC plating. These addition agents have been found to be useful under the present invention. The ability to use these addition agents is cumulative with the benefits of pulse plating, such as fine grain size, leveling, and smoothness. All of these benefits can be achieved by the rotational process of the present invention.

As a disc rotates, any one spot on its surface passes between the anode and experiences a current pulse. This pulse initiates metal deposition. This corresponds to the "on" time in regular pulse plating techniques. The length of this "on" time is a function of the disc rotation speed and the circumferential width of the anode. The current to the anodes remains on continuously as the disc rotates. As any one area of the disc passes away from the space between these anodes, that area no longer sees any current. This corresponds to the "off" period in normal pulse plating. This "off" period is also a function of the disc rotation rate and the circumferential distance to which the disc must rotate in order to come back to the anodes.

The effect of the disc rotation past the anodes is similar to the effects of regular pulse plating. Metallic cations existing essentially on the surface of the disc in the Helmholtz layer are highly mobile across the crystal lattices found there. In simple terms, like herds of cattle, they tend to congregate and plate out or be adsorbed at areas of high energy on the charged lattice. If the driving current is high, then small differences in charge between different points on the surface become negligible and no herding occurs. The metallic ions are literally thrown down onto the surface and remain wherever they land. This does not result in the most desirable deposit. A typical cubic nickel crystal is roughly 60 angstroms to a side. The optimum condition is to have the "on" time and current as the disc passes the anodes correspond to the nucleation energy plus the energy in amp-seconds (as calculated from Faraday's law) required to deposit an amount of metal roughly equal to the thickness of one such cubic crystal over a surface on the disc equal to that of the anode. This estimation should be made as if the anode and disc are stationary relative to each other.

As the portion of disc under consideration moves out of the vicinity of the anodes and is essentially in the "off" period of the cycle, mobile cations of relatively low energy on the disc surface are captured by similarly low energy lattice steps. The growth of the individual nucleation sites, as grains or crystal, gradually ceases as the capacitive layer is discharged and all available nucleation sites are occupied. In constant current DC plating, this gradual occupation of low energy nucleation sites does not occur and the original grains continue to grow in size as the thickness of the deposit increases. As the disc portion moves back into the "on" cycle near the anodes, the grains deposited during the previous cycle do not continue to grow in size because all available sites have been filled and the crystal has undergone a complete growth process. The lattices on the individual grains are not available as nucleation sites for new grains to develop. When depositing the nickel base layer, a very fine and homogeneous grain structure throughout the deposit results in an extremely smooth and even surface finish or profile. There is less variation of grain size and also of composition relative to the thickness of the layer. This is of considerable benefit in plating a thin film magnetic layer.

A general benefit to the disc rotation process is that the rotation itself provides an easily controllable means by which to change or alter the deposit characteristics by simply changing the rotation rate. The grain structure and the morphology of the individual grains is affected by the change of the rotation rate. The ability to control the morphology of the grain structure is displayed in varying distributions and combinations of grain sizes. The spacing of the grains relative to one another is a major factor which gives the ability to deposit a smoother, mechanically superior surface.

Importantly, the rotation rate is yet another means of control, (in addition to pH, temperature, air agitation, and current density) by which the nickel-to-phosphorus ratio can be precisely controlled. This means of control extends to the deposition of any such alloys, including those of nickel, cobalt, and phosphorus. Without altering the chemical constituents of the plating bath, the process of the present invention can be used to deposit an amount of cobalt. This cobalt can be deposited and controlled in relation to the nickel and phosphorus. This technique of controlling the rotation and the ability to change rotation from one speed to another allows a layered structure of varying compositions to be manufactured. This technique would also permit soft magnetic films, such as nickel/iron alloys, to be deposited onto the surface of the disc.

The cathode overpotential associated with the current density is a result of the need to charge the electric double layer at the cathode/solution interface. This electric double layer acts as a capacitor. Once this overpotential has been reached and the layer charged, metal deposition begins according to Faraday's law. The rotation of the disc/cathode substrate through the solution results in a significantly thinner capacitive double layer or diffusion layer due to the increased agitation at the interface. Since the thickness of this diffusion layer approaches the profile heights of the average microirregularities on the surface, the layer tends to conform to the surface. There will be more metal deposited on the peaks than on the recesses when the diffusion layer is significantly thicker than the heights of the peaks. As a result, any initial roughness is amplified. On the other hand, a thinner diffusion layer tends to conform to and follow the surface profile like a second skin. The peaks and recesses are then equally accessible and a high throwing power is the result. This occurs during the "off" time during rotation. An observation of the deposits as plated from this method show that a highly leveling type of deposit is occurring during the "off/on" time of the cycle. This leveling deposit is primarily the result of the type of bath and current densities used along with the rotational dynamics of the present invention. In the present invention, both a leveling deposit and a high throwing power type of deposit are occuring in same bath. It is believed that this results in the exceptional quality of plate produced.

The present invention eliminates the problems of oxidation and handling during transfers. Since the cathode is rotated on a central shaft from the inner diameter, the same fixture used in the plating can also be used in the pre-treatment process. There is no need to change fixtures. The rotation of the disc during pre-treatment results in an improved and highly homogeneous surface. This is particularly true for any zincated film that is introduced.

Since the present invention ideally incorporates refillable anodes, there is no problem with the decomposition of the anode structure.

The present invention results in the improvement of the plating rate and the ability to increase the cathode-to-anode surface area without harming the deposit characteristics. The rotation technique of the present invention causes a thinner diffusion layer. The thinner diffusion layer can charge and discharge faster. The rotational speed can thus be increased accordingly to achieve a desired leveling-to-throwing power ratio. Higher relative current densities can be achieved without depletion of the anodes.

The present invention greatly simplifies the process of maufacturing computer memory discs. First, the number of process steps required in memory disc production is greatly decreased by the use of the electrolytic, as opposed to the electroless, processing technique. Secondly, the high quality end product eliminates many of the process steps required to correct defects in the surface quality of the computer memory discs and to polish and/or burnish the surface of the disc. Thirdly, the arrangement of multiple discs on a single spindle greatly enhances the production capabilities. Fourthly, the arrangement of the apparatus lends itself to complete automation. since the number of process steps in the manufacture of computer memory discs is reduced, the cost of manufacturing is reduced and the output of manufacturing is greatly increased.

The foregoing disclosure and description of the invention is illustrative and explanatory thereof, and various changes in the method steps, as well as details in the illustrated apparatus may be made within the scope of the appended claims without departing from the true spirit of the invention.

I claim:

1. An apparatus for the electrolytic plating of computer memory discs comprising:

plating container means for receipt of a liquid plating bath;

spindle means fitted to said plating container means, said spindle means having a receiving area for fixing to the inner diameter of a computer memory disc;

prime mover means connected to said spindle means for causing relative rotational movement between said receiving area of said spindle and said plating container means;

stationary anode means fixed and non-translatable relative to said plating container means, said stationary anode means positioned on opposite sides of said receiving area of said spindle means;

electrical transmission means connected to said spindle means and to said stationary anode means, said electrical transmission means including a contact surface, said contact surface suitable for electrical contact with an edge of a computer memory disc, said electrical transmission means for passing a current between said contact surface and said stationary anode means; and current distribution control means positioned so as to be adjacent said contact surface within said plating container means, said current distribution control means for reducing the current flow between said stationary anode means and the edge of a computer memory disc affixed to said spindle means.

2. The apparatus of claim 1, said spindle means having a plurality of receiving areas for the receipt of a plurality of computer memory discs.

3. The apparatus of claim 2, said stationary anode means comprising a pair of anodes mounted within said plating container means on opposite sides of said receiving ara for each of said receiving areas on said spindle means.

4. The apparatus of claim 3, said electrical transmission means comprising:

a plurality of current regulators connected to said anodes, each of said anodes having a separate current regulator, said current regulator for controlling current flow to said anode means.

5. The apparatus of claim 1, said spindle means comprising:

a conductive rod extending through the interior of said spindle means;

a plurality of mechanical arms surrounding said conductive rod, said mechanical arms having a non-conductive outer coating and a conductive contact surface, said conductive contact surface for abutment against the inner diameter of a computer memory disc, said conductive contact surface being electrically conductive with said conductive rod.

6. The apparatus of claim 5, said spindle means further comprising:

cam means connected to said plurality of arms for causing said arms to move outwardly upon actuation of said cam means, said conductive contact surface for engaging the inner diameter of a computer memory disc upon such outward movement.

7. The apparatus of claim 1, said plating container means further comprising:

air agitation means positioned in said plating container means between said stationary anode means, said air agitation means for passing an inert gas parallel to and between said stationary anode means.

8. An apparatus for the electrolytic plating of computer memory discs comprising:

plating container means for receipt of a liquid plating bath;

spindle means fitted to said plating container means, said spindle means having a receiving area for fixing to the inner diameter of a computer memory disc;

prime mover means connected to said spindle means for causing relative rotational movement between said receiving area of said spindle and said plating container means;

stationary anode means fixed and non-translatable relative to said plating container means, said stationary anode means positioned on opposite sides of said receiving area of said spindle means, said anode means comprising:

an anode vessel positioned within said plating container means perpendicular to the bottom of said plating container means, said anode vessel having an interior area for the receipt of anodizing material; and a non-anodizing screen fastened to said anode vessel so as to allow said liquid plating bath to communicate with the interior area of said anode vessel, said non-anodizing screen having a first curvilinear edge generally corresponding to configuration with the radius of said receiving area of said spindle means;

electrical transmission means connected to said spindle means and to said stationary anode means said electrical transmission means including a contact surface, said contact surface suitable for electrical contact with an edge of a computer memory disc, said electrical transmission means for passing a current between said contact surface and said stationary anode means; and current distribution control means positioned so as to be adjacent said contact surface within said plating container means, said current distribution control means for reducing the current flow between said stationary anode means and the edge of a computer memory disc affixed to said spindle means.

9. The apparatus of claim 8, said non-anodizing screen having another curvilinear edge connected to said anode vessel and having a configuration with a radius greater than the radius of said first curvilinear edge.

10. The apparatus of claim 8, said non-anodizing screen comprising a flat section of titanium mesh.

11. The apparatus of claim 8, further comprising:

a plurality of anodic pellets contained within the interior area of said anode vessel, said anode vessel having an opening at the upper portion of said anode vessel for allowing the insertion of said anodic pellets into said anode vessel.

12. The apparatus of claim 11, said anodic pellets comprising sulphur-depolarized nickel material.

13. An apparatus for the electrolytic plating of computer memory discs comprising:

plating container means for receipt of a liquid plating bath;

spindle means fitted to said plating container means, said spindle means having a receiving area for fixing to the inner diameter of a computer memory disc, said spindle means comprising:

a conductive rod extending through the interior of said spindle means;

a collar surrounding said conductive rod, said collar having a non-conductive outer coating, said receiving area of said spindle means having a beveled surface for receiving the inner edge of a computer memory disc, said receiving ara being electrically conductive with said conductive rod;

prime mover means connected to said spindle means for causing relative rotational movement between said receiving area of said spindle and said plating container means;

stationary anode means fixed and non-translatable relative to said plating container means, said stationary anode means positioned on opposite sides of said receiving area of said spindle means;

electrical transmission means connected to said spindle means and to said stationary anode means, said electrical transmission means including a contact surface, said contact surface suitable for electrical contact with an edge of a computer memory disc, said electrical transmission means for passing a current between said contact surface and said stationary anode means, said electrical transmission means being electrically connected to said conductive rod for passing a current through said beveled surface; and current distribution means positioned so as to be adjacent said contact surface within said plating container means, said current distribution control means for reducing the current flow between said stationary anode means and the edge of a computer memory disc affixed to said spindle means.

14. The apparatus of claim 13, said collar comprised of conductive material adjacent said conductive rod, said collar having a non-conductive coating over the exterior of said collar.

15. The apparatus of claim 13, said prime mover means connected to said spindle means so as to cause said spindle means to rotate within said plating container means.

16. An apparatus for the electrolytic plating of computer memory discs comprising:

plating container means for receipt of a liquid plating bath;

spindle means fitted to said plating container means, said spindle means having a receiving area for fixing to the inner diameter of a computer memory disc;

prime mover means connected to said spindle means for causing relative rotational movement between said receiving area of said spindle and said plating container means;

stationary anode means fixed and non-translatable relative to said plating container means, said stationary anode means positioned on opposite sides of said receiving area of said spindle means;

electrical transmission means connected to said spindle means and to said stationary anode means, said electrical transmission means including a contact surface, said contact surface suitable for electrical contact with an edge of a computer memory disc, said electrical transmission means for passign a current between said contact surface and said stationary anode means; and current distribution control means positioned so as to be adjacent said contact surface within said plating container means, said current distribution control means for reducing the current flow between said stationary anode means and the edge of a computer memory disc affixed to said spindle means, said current distribution control means comprising a septum positioned within said plating container means between the receiving area of said spindle means and said stationary anode means, said septum for limiting the flow of current reaching the edge of a computer memory disc mounted on said spindle means, said septum comprising a non-conductive sheet having a generally circular opening, said circular opening having a plurality of projections extending inwardly.

17. The apparatus of claim 16, said septum having an inverted V-shaped area inwardly extending at the bottom of said circular opening, said inverted V-shaped area having a vertex aligned with the center of the cross-section of said spindle.

18. The apparatus of claim 16, said projections having a scalloped configuration, said generally circular shape being approximately 270 degrees of a circle.

19. The apparatus of claim 16, said current distribution control means comprising:

a first septum positioned between said stationary anode means and said receiving area of said spindle means; and a second septum positioned on the other side of said receiving area of said spindle means, said first and second septums being separated by greater than one-eighth of an inch, said first and second septums being in plane parallel to each other.

20. An apparatus for the electrolytic plating of computer memory discs comprising:

plating container means for the receipt of a liquid plating bath;

disc rotation means connected to said plating container means, said disc rotation means having a receiving area for affixing a computer memory disc, said disc rotation means for imparting rotational movement to an affixed computer memory disc;

stationary anode means fixed and non-translatable relative to said plating container means, said stationary anode means positioned on opposite sides of said receiving area of said disc rotation means, said stationary anode means comprising:

an anode vessel mounted to said plating container means, perpendicular to the bottom of said plating container means, said anode vessel having an interior area for the receipt of anodizing material; and a non-anodizing screen fastened to said anode vessel so as to allow said liquid plating bath to communicate with the interior area of said anode vessel; and electrical transmission means connected to said disc rotation means and to said stationary anode means, said receiving area including a conductive contact surface, said electrical transmission means for passing a current between said conductive contact surface and said stationary anode means.

21. The apparatus of claim 20, said non-anodizing screen having a first curvilinear edge generally corresponding in configuration with the radius of said receiving area of said disc rotation means.

22. The apparatus of claim 21, said non-anodizing screen having another curvilinear edge connected to said anode vessel and having a radius greater than the radius of said first curvilinear edge.

23. The apparatus of claim 22, said non-anodizing screen comprising a flat section of titanium mesh.

24. The apparatus of claim 20, further comprising:

a plurality of anodic pellets contained within the interior of said anode vessel, said anode vessel having an opening at the top of said anode vessel for allowing the insertion of said anodic pellets into said anode vessel.

25. The apparatus of claim 20, said anodic pellets comprising sulphur-depolarized nickel material.

26. An apparatus for the electrolytic plating of computer memory discs comprising:

plating container means for the receipt of a liquid plating bath;

disc rotation means connected to said plating container means, said disc rotation means having a receiving area for affixing a computer memory disc, and disc rotation means for imparting rotational movement to an affixed computer memory disc;

stationary anode means fixed and non-translatable relative to said plating container means, said stationary anode means positioned on opposite sides of said receiving area of said disc rotation means;

electrical transmission means connected to said receiving area of said disc rotation means and to said stationary anode means, said electrical transmission means for passing a current between said receiving area and said stationary anode means; and current distribution control means attached to said plating container means so as to be between said stationary anode means and said receiving area of said disc rotation means, said current distribution control means including a septum positioned within said plating container means parallel to said stationary anode means for limiting the flow of current reaching the edge of a computer memory disc affixed to said disc rotation means.

27. The apparatus of claim 26, said septum comprising a non-conductive sheet having a generally circular opening, said circular opening having a projection extending inwardly.

28. The apparatus of claim 27, said septum having an inverted V-shaped projection extending inwardly at the bottom of said circular opening, said inverted V-shaped projection having a vertex aligned with the center of the cross-section of said disc rotation means.

29. The apparatus of claim 27, said septum having a plurality of projections extending inwardly, said projections having a scalloped shape, said generally circular shape being approximately 270 degrees of a complete circle.

30. The apparatus of claim 26, said current distribution control means comprising:

a first septum positioned between said stationary anode means and said receiving area of said disc rotation means; and a second septum positioned on the other side of the receiving area of said spindle, said first and second septums being in plane parallel and separated by more than one-eighth of an inch.

31. An apparatus for the electrolytic plating of computer memory discs comprising:

plating container means for the receipt of a liquid plating bath;

disc rotation means attached to said plating container means, said disc rotation means having a first receiving area for affixing a first computer memory disc and a second receiving area for affixing a second computer memory disc;

a first stationary anode fixed and non-translatable relative to said plating container means, said first stationary anode positioned on one side of said first receiving area of said disc rotation means;

a second stationary anode fixed and non-translatable relative to said plating container means, said second stationary anode positioned on the other side of said first receiving area of said disc rotation means;

a third stationary anode fixed and non-translatable relative to said plating container means, said third stationary anode interposed between said second stationary anode and said second receiving area of said disc rotation means;

a fourth stationary anode fixed and non-translatable relative to said plating container means, said fourth stationary anode positioned on the other side of said receiving area from said third stationary anode; and electrical transmission means connected to said first and second receiving areas of said disc rotation means, said electrical transmission means connected to said first, second, third, and fourth stationary anodes, said first and second receiving areas including a contact surface suitable for passing current to an edge of a computer memory disc, said electrical transmission means for passing current between said contact surface and said first, second, third, and fourth stationary anodes.

32. The apparatus of claim 31, said first, second, third, and fourth stationary anodes being aligned in plane parallel.

33. The apparatus of claim 31, said electrical transmission means comprising:

a plurality of current regulators connected to said first, second, third, and fourth anode means, each of said anode means having a separate current regulator, said current regulator for controlling the current flow to said first, second, third, and fourth stationary anodes.

34. The apparatus of claim 33, said electrical transmission means further comprising:

a plurality of current controllers individually electrically connected to each of said first and second receiving areas of said disc rotation means.

35. The apparatus of claim 31, each of said first, second, third, and fourth stationary anodes comprising:

an anode vessel mounted to said plating container means perpendicular to the bottom of said plating container means, said anode vessel having an interior area for the receipt of an anodizing material; and a non-anodizing screen fastened to the side of said anode vessel adjacent receiving areas of said disc rotation means, said non-anodizing screen for allowing said liquid plating bath to communicate with said interior area of said anode vessel.

36. The apparatus of claim 35, said non-anodizing screen having a first curvilinear edge generally corresponding in configuration with the radius of said receiving area of said disc rotation means, said non-anodizing screen having another curvilinear edge connected to a lower portion of said anode vessel and having a radius greater than the radius than said first curvilinear edge.

37. The apparatus of claim 35, further comprising:

a plurality of anodic pellets contained within said interior area of said anode vessel, said anode vessel having an opening for allowing the insertion of said anodic pellets into said anode vessel.

38. A method of electrolytically plating a computer memory disc comprising the steps of:

fastening a computer memory disc to a rotation-imparting fixture;

submerging said computer memory disc entirely into an electrolytic plating bath;

rotating said computer memory disc in said plating bath at a rate of eight to eighteen revolutions per minute; and transmitting an electrical current through said rotation-imparting fixture to said computer memory disc, said electrical current passing from said computer memory disc to stationary anodes positioned on opposite sides of said computer memory disc, said computer memory disc being rotated while said current is being transmitted.

39. The method of claim 38, said step of fastening comprising:

sliding the inner diameter of said computer memory disc over the exterior of a spindle;

positioning said computer memory disc such that said computer memory disc extends radially from a contact surface on said spindle; and manipulating said spindle such that said computer memory disc is affixed to said spindle in electrical contact with said contact surface.

40. The method of claim 38, further comprising the step of:

agitating said electrical plating bath while said current is being transmitted.

41. The method of claim 38, further comprising the step of:

removing said electrical current from said computer memory disc;

removing said computer memory disc and said spindle from said electrolytic plating bath; and removing said disc from said spindle.

42. A method of electrolytically plating a computer memory disc comprising the steps of:

fastening a computer memory disc to a rotation-impairing fixture;

submerging said computer memory disc entirely into an electrolytic plating bath;

rotating said computer memory disc in said plating bath at a rate of eight to eighteen revolutions per minute;

transmitting an electrical current through said rotation-impairing fixture to said computer memory disc, said electrical current passing from said computer memory disc to stationary anodes positioned on opposite sides of said computer memory disc, said computer memory disc being rotated while said current is being transmitted, and diverting said electrical current from the edges of said computer memory disc.

* * * * *